US005551160A

United States Patent [19]

Ferris et al.

[11] Patent Number: 5,551,160

[45] Date of Patent: Sep. 3, 1996

[54] CALCULATING GRAPHIC SCALER

[76] Inventors: Byron S. Ferris, 11645 SW. Lynnridge, Portland, Oreg. 97225; Loren T. Weeks, 43 Aquinas, Lake Oswego, Oreg. 97035

[21] Appl. No.: 296,221

[22] Filed: Aug. 24, 1994

[51] Int. Cl.[6] ..... B43L 7/10

[52] U.S. Cl. ..... 33/452; 33/464; 33/DIG. 9

[58] Field of Search ..... 33/DIG. 9, 1 F, 33/1 B, 1 K, 1 SB, 1 SD, 427, 428, 452, 464, 487

[56] References Cited

U.S. PATENT DOCUMENTS

| | | | |
|---|---|---|---|
| 990,385 | 4/1911 | Pierce | 33/1 SB |
| 1,116,888 | 11/1914 | Heyn | 33/DIG. 9 |
| 1,976,278 | 10/1934 | Cook | 33/427 |
| 2,300,401 | 11/1942 | Basler et al. | 33/DIG. 9 |
| 2,403,614 | 7/1946 | Ross | 33/DIG. 9 |
| 2,626,467 | 1/1953 | Abbott | 33/427 |
| 3,878,615 | 4/1975 | Peterson | 33/DIG. 9 |
| 4,270,173 | 5/1981 | Suttler | 364/564 |
| 4,417,399 | 11/1983 | Baliozian | 33/DIG. 9 |
| 4,633,591 | 1/1987 | Pikora | 33/DIG. 9 |

FOREIGN PATENT DOCUMENTS

| | | | |
|---|---|---|---|
| 2678725 | 1/1993 | France | 33/427 |
| 161585 | 5/1933 | Switzerland | 33/DIG. 9 |
| 2167015 | 5/1986 | United Kingdom | 33/427 |

*Primary Examiner*—Thomas B. Will

*Attorney, Agent, or Firm*—Kolisch, Hartwell, Dickinson, McCormack & Heuser

[57] ABSTRACT

A crop, measure and scale system and a measure and scale system are provided for use in preparing an original image for processing. The crop, measure, and scale system includes first and second corner members which define an infinitely adjustable image frame. Each corner member includes a pair of diverging arms, one arm being characterized as an abscissa arm and the other as an ordinate arm, each of which includes an internally facing edge. A calculating measure is mounted on one of the corner members, such calculating measure including a slide rule with a ruler which extends between opposite edges of the cropped image, and a slide which provides for calculation of a reduction/enlargement percentage based on a predetermined desired dimensional change. The measure and scale system includes the calculating measure described above joined to an elongate member.

9 Claims, 4 Drawing Sheets

CALCULATING GRAPHIC SCALER

TECHNICAL FIELD

The present invention relates generally to the preparation of graphic images for processing, and more particularly, to a system whereby images are visually cropped, measured and scaled (in an infinitely choosable way), or in some instances just measured and scaled in the same way. The two practices are accomplished, on the one hand, via a device which employs a pair of relatively adjustable, angular (orthogonal) corner members, at least one of which includes an onboard calculating slide rule, or, on the other hand, via a related device which includes a pair of relatively moving members which bear markings enabling both measurement and calculating logarithmic scaling. Although the invention has broad utility, it is described below for use in a graphic arts environment, a context in which particular utility has been shown.

BACKGROUND ART

Until now, graphic artists and designers have prepared images for processing using a variety of separate, single-function tools. Visual cropping, for example, has been accomplished by placement of a plurality of rulers (or other straight edge devices) on an image so as to obscure portions of the image from view. This procedure has required careful alignment of the image on a table, and of the rulers on the image so as to ensure that the visually cropped image will be "square". Measuring the dimensions of the cropped image also has required careful alignment of the rulers, such dimensions generally being taken by measuring the distance between a pair of rulers which define opposite borders of a cropped image therebelow. The rulers must be held in position simultaneously, adding further to the difficulty of the task.

After the image has been visually cropped and measured, it has been conventional to calculate a reduction/enlargement percentage, such percentage corresponding to a desired change in the image's size. The calculation of such reduction/enlargement percentage previously has been accomplished using a "proportion wheel", a device which is manipulatable to identify the reduction/enlargement percentage by setting a measured dimension and a corresponding desired dimension on the wheel. In a somewhat related practice which does not involve cropping, but rather just measuring and scaling, a linear ruler has been used for the measuring activity and thereafter, the same kind of scaling wheel just mentioned has been used for the calculating activity. In both prior art practices therefore, the designer must manipulate two tools to accomplish the desired end results.

It would be desirable to provide a system which does not require the manipulation of a variety of different tools. It is therefore an object of this invention to provide a system which, where cropping is desired, allows such to be accomplished easily visually without requiring precise alignment of rulers, and with respect to scaling, enables the same without necessitating the use of a separate calculating device.

SUMMARY OF THE INVENTION

The aforementioned objects are addressed by provision of two similar systems, one of which is a crop, measure and scale system and the other of which is a measure and scale system. Both systems are for use in preparing an image for processing. The crop, measure and scale system includes a pair of interrelated members which move relatively to define an adjustable cropped image frame. The members preferably take the form of a pair of L-shaped corners, or corner members, the corner members have arms that come together to define a size-adjustable rectangular frame. Each corner member, in its arms, includes a pair of edges, each edge being defined as either an abscissa or an ordinate edge. The abscissa edges define upper and lower borders of a cropped image, and the ordinate edges define opposite side borders so as to complete the image frame. The image height and width are measured by fixed rulers which extend along the edges of one of the corner members, one ruler being arranged to indicate positively the distance between facing abscissa edges, and the other ruler being arranged to indicate positively the distance between facing ordinate edges. A calculating measure is mounted on one of the corner members, such measure including a slide rule which employs one of the rulers as the slide rule's ruler, and a sliding logarithmic scale as the slide rule's slide. The slide rule's ruler includes a translator which converts a dimensional measurement to a logarithmic scale. The slide rule's slide includes related logarithmic reduction percentage, and enlargement percentage scales. This arrangement provides for infinitely choosable/variable calculation of a reduction/enlargement percentage based on a desired dimensional change of the cropped image's size. The measure and scale system includes the calculating measure described above on an elongate member. The measure and scale system provides a single tool that can be used both to measure an image and to calculate a reduction/enlargement percentage based on the desired dimensional change of the image's size.

BRIEF DESCRIPTION OF THE DRAWINGS

The preferred embodiment of the measure and scale system is simply a subset of the preferred embodiment of the crop, measure and scale system. Thus, to economize space, a single set of drawings is used to illustrate both the preferred embodiment of the crop, measure and scale system and the preferred embodiment of the measure and scale system. The reader is asked to first view the figures as illustrations of the preferred embodiment of the crop, measure and scale system, then the reader is asked to re-view the figures and focus only on those elements which illustrate an embodiment of the measure and scale system.

FIG. 1. (first functionality) is a somewhat simplified top plan view of a crop, measure and scale system constructed in accordance with the present invention, the system including a pair of interrelated corner members with an onboard calculating measure arranged to frame a cropped image which is 6-inches wide by 5-inches high. In its second functionality role, to be explained more fully below, FIG. 1 illustrates the proposed measure and scale system.

FIG. 1A (first functionality) is an enlarged fragmentary top plan view of the crop, measure and scale system shown in FIG. 1, the view illustrating operation of such system where the image's width is to be reduced. FIG. 1A's second functionality role will become clear in the appropriate description below.

Figure 1:
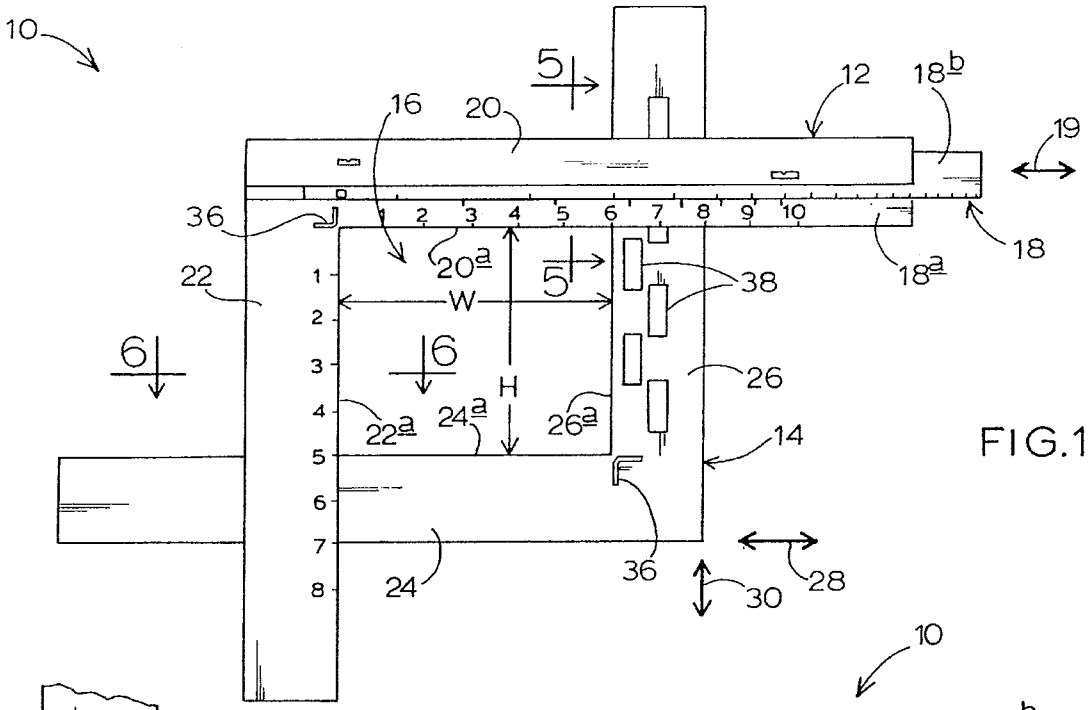
FIGS. 1, 1A, 2 and 2A serve the dual functionality illustration task just mentioned.

FIG. 2 (first functionality) shows the crop, measure and scale system of FIG. 1 wherein the corner members have been moved relative to one another to frame a cropped image which is 3-inches wide by 3-inches high. The FIG. 2 second functionality role tracks below with the FIG. 1 second functionality role.

Figure 2:
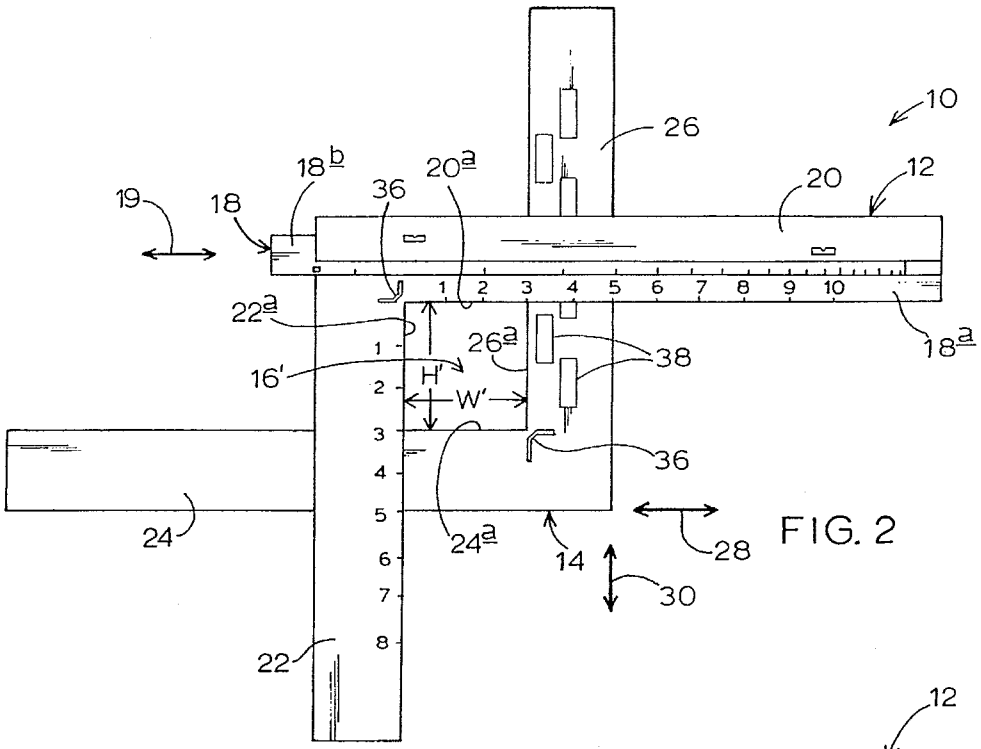
Figure 2A:
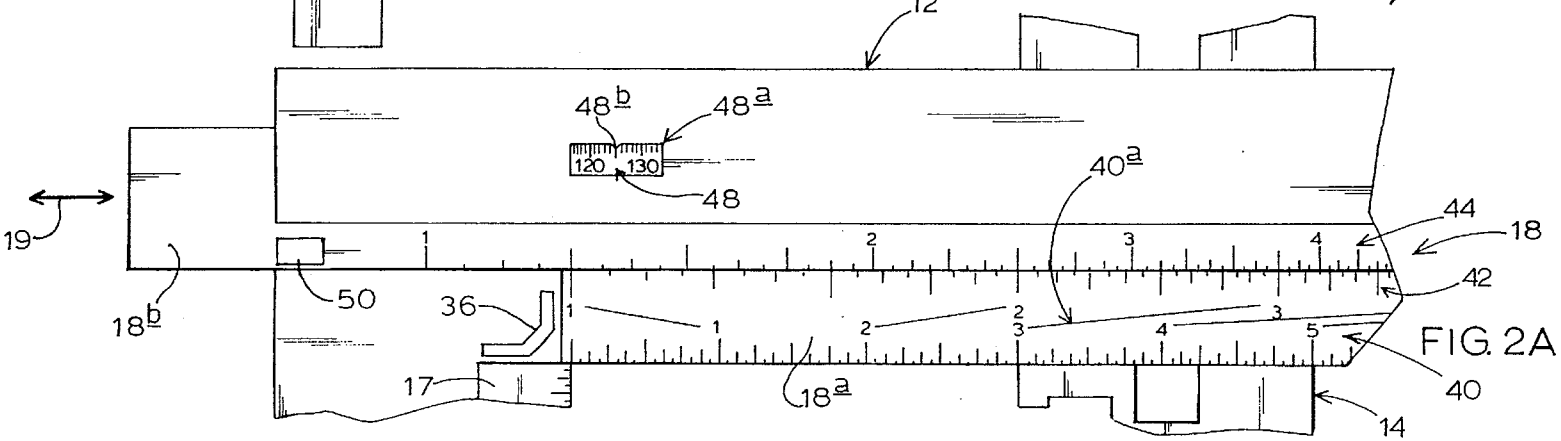

FIG. 2A (first functionality) is an enlarged fragmentary top plan view of the system in the arrangement shown in FIG. 2, the view illustrating operation of such system where the image's width is to be enlarged. Second functionality performance of this figure follows that of the FIG. 2 second functionality.

Figure 3:
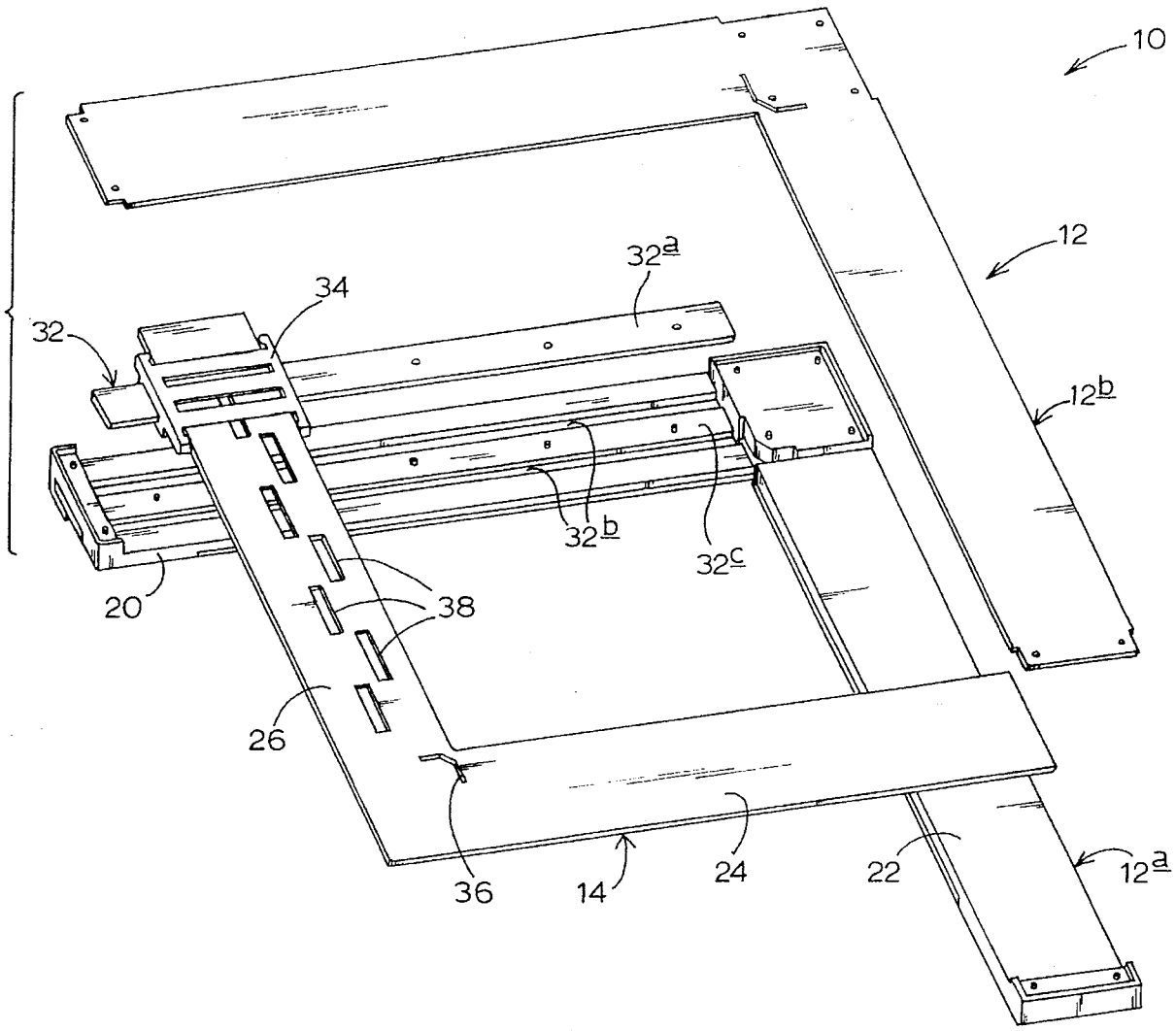

FIG. 3 is a partially exploded isometric view of the preferred embodiment of the crop, measure and scale system as viewed from below.

Figure 4:
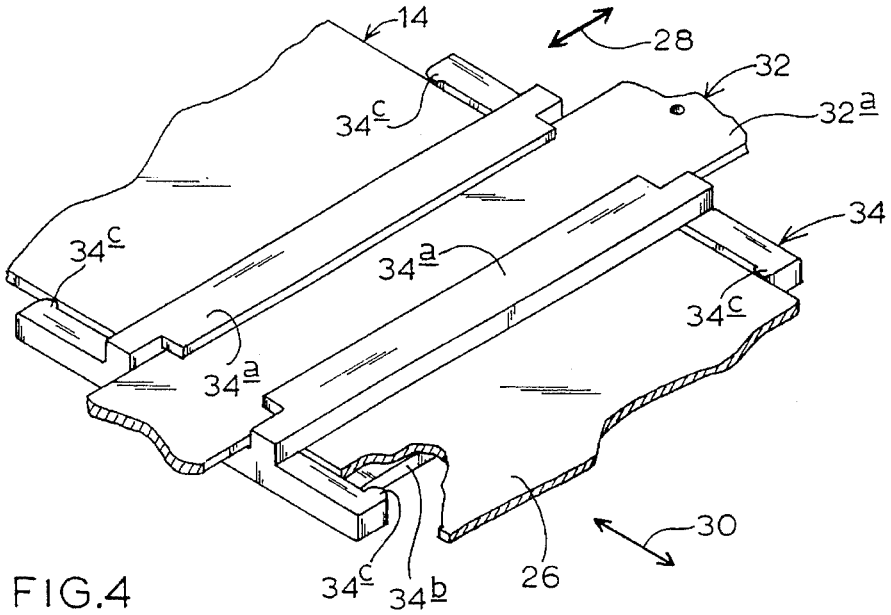

FIG. 4 is a fragmentary, enlarged isometric view illustrating a track and carriage arrangement whereby the corner members are interrelated.

Figure 5:
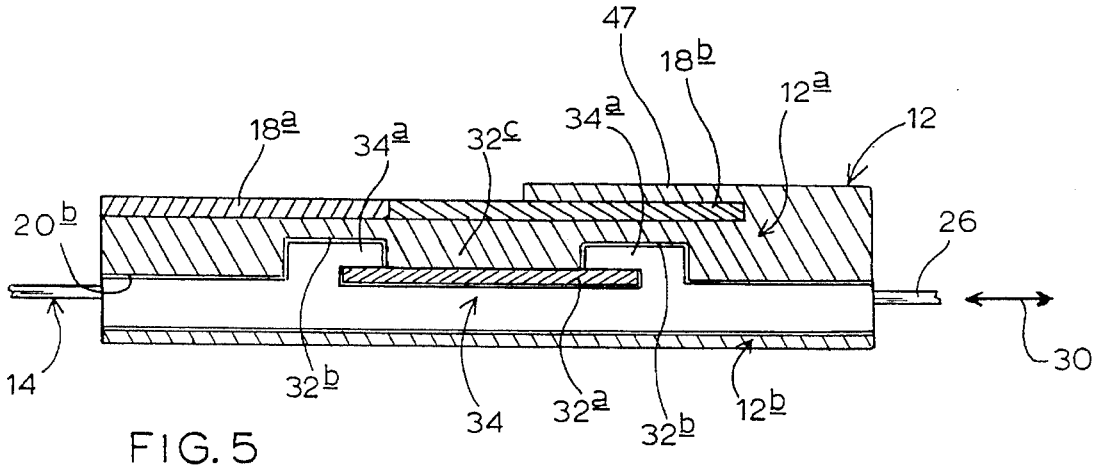

FIG. 5 is a further enlarged sectional view taken generally along line 5—5 of FIG. 1.

Figure 6:
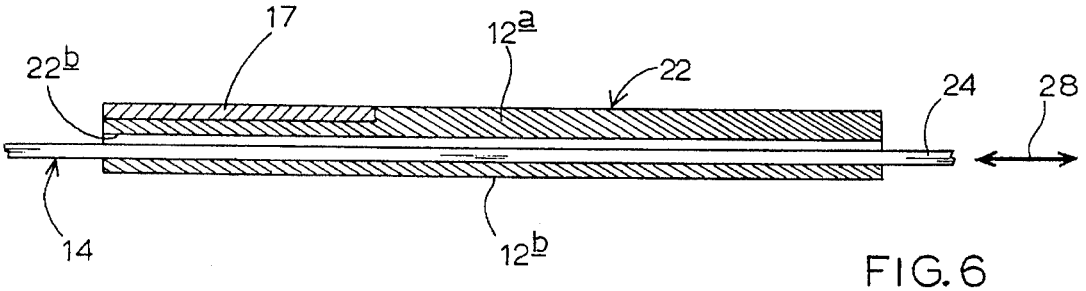

FIG. 6 is a sectional view, on about the same scale as FIG. 5, taken generally along line 6—6 of FIG. 1.

DETAILED DESCRIPTION OF PREFERRED EMBODIMENTS OF, AND BEST MODE OF CARRYING OUT, THE INVENTION

1. Crop, Measure and Scale System

As previously indicated, the present invention relates generally to the preparation of a graphic image for processing, and more particularly, to a calculating graphic scaler in the form of a system which provides for visual cropping of the image, measurement of a cropped image's dimensions, and determination of a reduction/enlargement percentage which corresponds to a desired change in image size. A preferred embodiment of such system is depicted in the drawings, the system being indicated generally at 10.

Referring initially to FIG. 1, it is to be noted that crop, measure and scale system 10 includes a pair of facing, interrelated first and second corner members 12, 14, respectively, such corner members being relatively movable so as to define an adjustable image frame. The frame in turn defines a cropped image 16. The corner members preferably take the form of facing right angles (90° angles), each of which is defined by a pair of diverging arms. One of the corner members includes a calculating slide rule, or second elongate linear element, 18. The arms are characterized as abscissa and ordinate arms, such arms corresponding to X and Y coordinates of a graph in the plane of the drawing sheets as viewed in FIGS. 1 and 2. As indicated, corner members 12 and 14 are interrelated, the ordinate arm of member 14 intersecting the abscissa arm of member 12, and the abscissa arm of member 14 intersecting the ordinate arm of member 12. The corner members thus define an image frame which in turn defines the borders (or perimeter) of the image framed thereby. Member 12 acts as a base relative to which member 14 is moved in infinitely adjustable ways such relative movement providing for infinite adjustment of the frame size. This is illustrated by X-axis arrow 28 and Y-axis arrow 30, member 14 being readily movable either in the X or Y direction so as to vary the size of the frame. Such relative movement is further illustrated by comparison of FIGS. 1 and 2.

In accordance with the preferred embodiment first corner member 12 will be understood to include a first abscissa arm 20, which is also referred to herein as a first elongate linear element, and a first ordinate arm 22. Arm 20 defines a first abscissa edge 20*a*, and edge 20*a* defines a first abscissa border of cropped image 16. Arm 22 defines an ordinate edge 22*a* and correspondingly a first ordinate border of cropped image 16. The first corner member thus may be considered to define a first perimeter extent of the image which is framed.

Similarly, second corner member 14 defines a second abscissa arm 24 and a second ordinate arm 26. Arm 24 defines a second abscissa edge 24*a* and arm 26 defines a second ordinate edge 26*a*, each edge defining a corresponding border of cropped image 16. These borders collectively make up a second perimeter extent of the image which is framed.

Arm 22 together with corner member 14 are referred to collectively herein, in relation to arm 20, as operatively joined structure.

Focussing for a moment on the perimeter defined by the system, it will be appreciated that such system frames what may be considered a visually cropped image by placement of the system on an original image so as partially to cover the image with corner members 12 and 14. As shown, the resulting visually cropped image is generally rectangular, and is dimensioned to have a width W and a height H. In FIG. 1, the frame is 6-inches wide by 5-inches high. These dimensions are indicated by rulers along the abscissa and ordinate arms of corner member 12. The frame dimensions, however, may be altered in an infinitely choosable way by relative movement of the corner members as indicated by arrows 28 and 30.

In FIG. 2, the corner members have been moved relative to one another, so as to define a smaller visually cropped image 16'. Image 16' will be seen to have a height H' of 3-inches and a width W' of 3-inches. It is to be noted that movement is such that the rectangularity of the visually cropped image is maintained. A description of the mechanism by which such controlled movement is achieved is described in detail below.

FIG. 3 shows an exploded isometric view of the invented system, such view further illustrating the relationship between the first and second corner members and the controlled relative movement thereof. First corner member 12 includes a pair of corresponding sections 12*a*, 12*b* which come together to define slots (20*b* in FIG. 5; 22*b* in FIG. 6) through which the second corner member 14 is controllably passed. The sections are secured together via suitable fasteners which take the form of a pin and socket arrangement in the embodiment shown. As indicated by arrows 28, 30 (FIGS. 1 and 2), the arms of the second corner member are movable through the slots, but only in directions which are perpendicular to the first corner member's corresponding arms. This makes for a system whereby the width and height of a visually cropped image may be altered while maintaining the rectangularity nature of the frame.

Referring still to FIG. 3, it will be noted that abscissa arm 20 of the invented system provides a track 32, such track accommodating controlled movement of member 14 relative to member 12. As indicated, track 32 is defined along arm 20 which is combined with a track-defining plank 32*a*. Plank 32*a* is secured to a projecting pedestal 32*c* of arm 20, providing a pair of grooves 32*b*. A carriage 34 rides along the track and is held on the track by a pair of shoes 34*a* which ride in grooves 32*a* to grip the plank in a manner illustrated in FIGS. 5 and 6.

Turning to FIG. 4, it will be noted that the carriage defines a channel 34*b* through which arm 26 of corner member 14 is slidably received. This allows for controlled movement of corner member 14 either perpendicular or parallel to the system's first abscissa arm 20. The second corner member's ordinate arm 26 thus is captured between shoes 34*a* and a plurality of channel-defining underlying bars. FIG. 4 further illustrates the sliding relationship between the first and second corner members, such relationship being illustrated by arrows 28 and 30 from FIG. 1. Tabs 34*c*, ensure a well-defined, but low-resistance, path of second corner member 14. This arrangement is also illustrated in FIG. 5, it being made apparent that shoes 34*a* capture plank 32*a* for sliding passage of the carriage therealong. The track-defining plank 32*a*, it will be recalled is secured to abscissa arm 20, providing for a controlled relationship between carriage 34 and arm 20. FIG. 5 also provides a view of slot 20*b*, through which arm 26 is slidably passed.

FIG. 6 shows, in cross-section, the relationship between the second corner member's abscissa arm 24 and the first corner member's ordinate arm 22, it being clear that the track and carriage arrangement is not necessary at both intersections of the first and second corner members. As indicated, the arm 24 passes through a channel 22*b* formed in arm 22, the channel being defined by the upper and lower sections 12*a*, 12*b* of corner member 12.

Once an image has been visually cropped, the image may be marked with lines designating the cropped image using a felt pen or the like. Such markings may be made, for example, through slots (or apertures) in the corner members such as those shown at 36. The slots extend entirely through each corner member and are intended for marking at opposite corners of the image where the image is rectangular. Additional marking slots may be provided in the arms of the corner members, representative examples of such slots being indicated generally at 38. These slots provide for marking along a side edge of the image.

Once the image has been visually cropped, attention shifts to the calculating measure 18 which, in the preferred embodiment, is mounted along abscissa arm 20 of corner member 12. As indicated, the calculating measure takes the form of a slide rule, such slide rule including of a stationary ruler 18*a* and a movable slide element 18*b*. The stationary ruler is configured to allow for measurement of the image's width W, such ruler extending along the system's first abscissa edge 20*a*. A similar ruler 17 (FIG. 2A) extends along the system's first ordinate edge 22*a* so as to provide for measurement of the image height H. As suggested by arrow 19, the slide rule's slide 18*b* is movable relative the slide rule's ruler 18*a* along the length of the slide rule ruler, such movement generally being undertaken so as to calculate a reduction/enlargement percentage based on a desired change in visually cropped image size as will now be described.

Figure 1A:
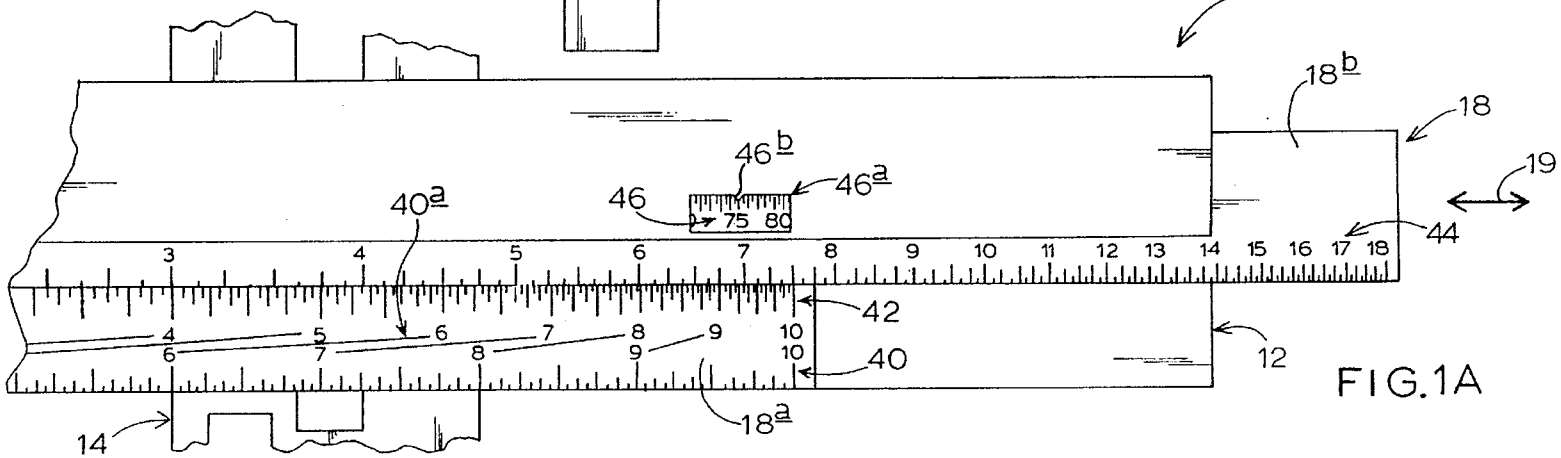

Referring now to FIG. 1A, determining the percentage of reduction of an image such as image 16 is provided, the system's calculating measure being shown in detail. As indicated, the image has been chosen to have a width W of 6-inches, such width being read from a linear scale 40 which appears on ruler 18*a* along the edge of the first corner member's abscissa arm. The ruler, it will be recalled, is fixed to the first abscissa arm. As also indicated, the stationary ruler 18*a* includes a first logarithmic conversion scale 42 which is positioned to extend adjacent (and parallel) slide rule slide 18*b*. The logarithmic scale is associated with the linear scale as by lines such as that shown at 40*a*. This association effectively converts a linear measurement to the logarithmic scale. The stationary ruler thus acts as a translator and is referred to as such herein. Consequently, the measured width W is readily represented on the logarithmic scale 42 for further manipulation by the slide rule's slide.

Scales 40, 42 are referred to herein also as first and second fixed, linearly-distributed, elongate scale structures, respectively, with each scale containing what are called original-image measurement indicia marks.

Referring more specifically now to the system's slide, it will be noted that such slide includes a second logarithmic scale 44, such scale being positioned adjacent the first logarithmic scale to provide for manipulation of the calculating measure to denote a predetermined desired dimensional change in the image's width. Those skilled will appreciate, for example, that the second logarithmic scale 44 has been moved, in FIG. 1A, to denote a reduction from a width of 6-inches to a width of 4½-inches, the second logarithmic scale being arranged to indicate a predetermined desired image width. The second logarithmic scale thus has been offset relative the first logarithmic scale to indicate a width 4½-inches where the first logarithmic scale indicates a width of 6-inches. It should also be noted that, although the current description refers the image width W, calculations may similarly be made regarding the image height by reference to values corresponding to the measured height H on the linear and logarithmic scales.

As shown, the slide is contained within a groove in the first abscissa arm, and is partially covered by a shield (47 in FIG. 5) so as to obscure additional scales marked thereon. In FIG. 1A, one of these additional scales is shown at 46, such scale taking the form of a reduction percentage scale. Scale 46 represents a percentage of reduction which corresponds to the relative offset of the first and second logarithmic scales. The reduction percentage scale appears only partially through a window 46*a* in the shield 47, the corresponding percentage of reduction being indicated by a pointer, cursor, or marker 46*b*.

In the depicted arrangement of FIGS. 1 and 1A, where the width measurement is to be changed from 6-inches to 4½-inches, it will be appreciated that the image will be reduced to 75% of its original size. By appropriate relative placement of the first and second logarithmic scales in the fashion indicated, it therefore is possible to provide for simultaneous indication of a linear dimension reduction.

Turning now to FIG. 2A, and by similar analysis, it will be noted that the enlargement percentage of image 16' similarly may be determined by manipulation of slide 18*b*, and by reading of an enlargement percentage scale 48 which is seen through a second window 48*a*. A pointer, cursor (or marker) 48*b*, indicates the enlargement percentage directly. The second window is offset both vertically and horizontally (as viewed in FIG. 2A) from the first window, avoiding overlap of the scales.

Cursors 46*b*, 48*b* constitute cursor structure herein.

As indicated in FIG. 2A, cropped image 16' has a width of 3-inches which is to be enlarged to approximately 3¾-inches. This enlargement will be understood by reference to the relationship between the first and second logarithmic scales, such scales being offset so that the second logarithmic scale indicates a width of 3¾-inches where the first logarithmic scale indicates a width of 3-inches. Correspondingly, pointer 48*b* indicates an enlargement percentage of 125%. The slide is moved by hand, and may further include a tab 50 as a finger hold.

Setting forth now certain additional terminology which is used in conjunction with structures just described, within member or element 18, scale 44 is referred to as a first scale structure, and scales 46, 48 are designated collectively as a second scale structure, with each of these two scale structures containing reprocessed-image calculation indicia marks. In particular, the marks in scale 44 are described as reprocessed-image dimensional indicia marks, and those in scales 46, 48 as reprocessed-image percentage-scale-resizing indicia marks. It is important to note, what should be clearly evident from the natures of the structures so far described, that each indicia mark in scale 44 has a non-exclusive, infinitely variable relationship with each indicia mark in each of scales 46, 48, and vice versa.

Those skilled will appreciate that use of English dimensional units (i.e., inches) is illustrative only, and that other units of measure obviously easily could be employed.

2. Measure and Scale System

As has been set forth in the Background and Summary of this invention, and as was explained with reference to the descriptions of FIGS. 1, 1A, 2 and 2A in the drawings, there are two slightly different embodiments of this invention. The characteristics of which are illustrated by taking slightly different view points of and readings with respect to the interpretations of these four drawing figures. In the description which now follows of the preferred embodiment of the measure and scale system, the reader is asked to focus attention on certain portions only of the structures illustrated in FIGS. 1, 1A, 2 and 2A with the view toward eliminating from consideration, in a manner of thinking, certain structural components which do not play any role in the construction and functionality of the embodiment of the invention now to be described. Elements of this now-to-be-described embodiment of the invention which are common, in the sense, with like elements in the first-above-described embodiment bear the same reference :numerals.

A preferred embodiment of the measure and scale system is shown in FIGS. 1 and 2 as the abscissa arm of corner member 12 together with the calculating measure within and upon the abscissa arm. This embodiment can be visualized by focussing on the abscissa of corner member 12 and ignoring the ordinate of corner member 12 and the whole of corner member 14. Thus, it can be seen that the measure and scale system includes a ruler 18*a* along an elongate edge 20*a*, and a calculating slide rule 18. The ruler and calculating slide rule are part of a calculating measure which is shown in detail in FIGS. 1A and 2A. These figures illustrate how the calculating measure can be used to calculate either a reduction percentage for an image, FIG. 1A, or an enlargement percentage for an image, FIG. 2A. Only the elements in FIG. 1A and 2A that are part of the calculating measure or part of the abscissa of corner member 12 are elements of the measure and scale system. Thus elements 14, 17 and 36 are not part of the measure and scale system. FIGS. 1A and 2A were discussed previously in describing the calculating measure used in the crop and measure system. Since the calculating measure used in the measure and scale system is identical to that used in the crop, measure and scale system, the reader is referred to the previous discussion of FIGS. 1A and 2A for a detailed description of the calculating measure.

It should thus be apparent how the preferred embodiments of this invention which direct their respective attentions to two different aspects of graphics "manipulation" i.e. crop, measure and scale, and measure and scale, respectively, offer distinct advantages in the practice of these activities in relation to prior art practices utilizing prior available tools in the trade so-to-speak. Put succinctly, the embodiments of the present invention, with regard to their respective practice arenas, enable the desired steps and stages of graphic manipulation to be performed by using but a single tool into which are integrated all of the elements necessary to perform the respective required steps. By using a structure made in accordance with the present invention, no longer is it necessary for a user to possess and reach for two very different kinds of tools to perform two very different kinds of functions. In both embodiments, one can say in a very simple manner of speaking that one tool does it all.

It should also be apparent to those skilled in the art that the proposed embodiments of the present invention are relatively simple and inexpensive to manufacture, and require no substantial re-education, or "new-technology" adaptation for their successful and convenient use.

Although preferred embodiments of the inventions have been disclosed, it should be appreciated that variations and modification may be made thereto without departing from the spirit of the inventions as claimed.

It is desired to secure by Letters Patent:

1. A measure and scale system for use in preparing an original image for infinitely selectable resize processing to a reprocessed image, said system comprising a first, elongate linear element including first and second, fixed, linearly-distributed, laterally spaced, elongate scale structures each containing original-image measurement indicia marks, and a second, elongate linear element, mounted on said first element for reversible, longitudinal, relative sliding movement, and including first and second, fixed, linearly-distributed, laterally spaced, elongate scale structures each containing reprocessed-image calculation indicia marks, with one of these second-mentioned scale structures including reprocessed-image dimensional indicia marks, and the other such scale structure including reprocessed-image percentage-scale-resizing indicia marks, and with each indicia mark in said one scale structure having a nonexclusive, infinitely variable relationship with each indicia mark in said other scale structure, and vice versa.

2. The system of claim 1, wherein said first element includes cursor structure adjacent which said reprocessed-image percentage-scale-resizing indicia marks are exposed for view, and wherein resizing scaling is accomplished by sliding said first and second elements relative to one another, in an infinitely choosable way, and in a manner juxtaposing a selected, original-image measurement indicia mark in one of the scale structures in said first element with a selected, reprocessed-image, dimensional indicia mark in said one scale structure in said second element, and thereafter making a reading on and with respect to indicia information contained in said other scale structure exposed adjacent said cursor structure.

3. The system of claim 2, wherein said other scale structure in said second element includes a reduction-percentage-scale and an enlargement-percentage-scale, said first element includes a pair of windows each adapted to expose, selectively, indicia marks contained in a different one of said two scales, and said cursor structure includes a different cursor associated respectively with each one of said two windows.

4. The system of claim 1, wherein the scale structures in each of said elements include at least one logarithmic scale.

5. The system of claim 2, wherein the scale structures in each of said elements include at least one logarithmic scale, and such juxtaposing occurs between the indicia marks in a logarithmic scale in said first element and in a logarithmic scale in said second element.

6. The system of claims 1 or 2 which further includes structure operatively joined to said first element enabling two-dimensional cropping of an original image.

7. The system of claim 6, wherein said operatively joined structure includes an elongate arm formed with, and extending from adjacent one end of, said first element (which first element can be thought of also as being an arm) to define therewith a first angular corner member, and a second, generally similar, dual-arm angular corner member mounted on and with respect to said first corner member for reversible, infinitely selectable movement with respect thereto in reverse directions which extend along lines corresponding to the like angles between the arms in the corner members.

8. The system of claim 7, wherein, in each of said two corner members, the respective arms include inside-corner, orthogonally-disposed ordinate and abscissa edges employable to define the perimeter of a cropped image.

9. The system of claim 8, wherein said scale structures in said first element extend generally along and substantially parallel to the abscissa edge of the corner member in which the first element is incorporated, and said second corner member includes an elongate scale structure containing dimensional indicia marks extending along and substantially parallel to the ordinate edge in the second corner member.

* * * * *